US007670169B1

(12) United States Patent
Pai

(10) Patent No.: US 7,670,169 B1
(45) Date of Patent: Mar. 2, 2010

(54) CONNECTING DEVICE WITH CABLE

(75) Inventor: Jason Pai, Shenkeng Township, Taipei County (TW)

(73) Assignee: Taiwan Line Tek Electronics Co., Ltd., Taipei County (TW)

( * ) Notice: Subject to any disclaimer, the term of this patent is extended or adjusted under 35 U.S.C. 154(b) by 0 days.

(21) Appl. No.: 12/409,678

(22) Filed: Mar. 24, 2009

(51) Int. Cl.
*H01R 13/58* (2006.01)

(52) U.S. Cl. ..... 439/465

(58) Field of Classification Search ..... 439/465, 439/455, 687, 108
See application file for complete search history.

(56) References Cited

U.S. PATENT DOCUMENTS 3,856,376 A * 12/1974 Poliak et al. ..... 439/465
3,934,076 A * 1/1976 Smith ..... 174/87
4,679,877 A * 7/1987 Ahroni ..... 439/425

* cited by examiner

*Primary Examiner*—Phuong K Dinh
(74) *Attorney, Agent, or Firm*—Guice Patents PLLC

(57) ABSTRACT

The present invention relates to a connecting device with cable, a top housing, one end of a hollow main body provided in the top housing is extended with a connecting device for being connected to a power adapter; an interior retaining sleeve; two copper contact rings; a bottom plastic housing; a conduction wire retaining section for being mounted in a latching slot; and a cable having at least two conduction wires, end sections of the two conduction wires enter the top housing and the bottom plastic housing then are respectively connected to a clamping section. Accordingly, with the above mentioned structure, one end of the connecting device with cable is connected to an AC power source through the cable, the other end thereof is coupled with a power adapter through the connecting device so as to supply converted DC power to an electronic device.

9 Claims, 13 Drawing Sheets

CONNECTING DEVICE WITH CABLE

BACKGROUND OF THE INVENTION

1. Field of the Invention

The present invention relates to a connecting device, more particularly to a connecting device with cable, one end thereof is connected to an AC power source through the cable, the other end thereof is coupled with a power adapter through the connecting device so as to supply converted DC power to an electronic device.

2. Description of Related Art

An electronic device e.g. a notebook computer often consumes DC power, so a power adapter is needed to convert AC power into DC power for supplying converted DC power to the notebook computer.

Referring to FIG. 1*a*, which is a schematic view illustrating connection of a conventional power adapter. As shown in FIG. 1*a*, the conventional power adapter 100 often has a power wire 110 and an adapter main body 120; one end of the power wire 110 has a plug 111 for being connected to a socket (not shown) for obtaining required AC power, the other end thereof is directly connected to the adapter main body 120, so AC power is able to be converted into DC power by the adapter main body 120 and the converted DC power is supplied to the notebook computer. But for the power wire 110 as shown in FIG. 1*a*, the type of the plug 111 is fixed and not changeable, so when the type of socket of AC power is different from the type of the plug 111, the notebook computer is not able to be used.

Referring to FIG. 1*b*, which is a schematic view illustrating connection of another conventional power adapter. For improving disadvantages of the above mentioned power adapter, a power adapter 200 is invented, the power adapter 200 has a power wire 210 and an adapter main body 220, one end of the power wire 210 has a plug 211 for being connected to a socket (not shown) for obtaining required AC power, the other end of the power wire 210 has a plug 212, one end of the adapter main body 220 has a socket 221 served to be connected with the plug 212, so AC power is able to be converted into DC power by the adapter main body 220 and the converted DC power is supplied to the notebook computer. The type of the plug 211 of the power wire 210 as shown in FIG. 1*b* is changeable with respect to different specifications, but the plug 212 only has two conduction wires so is only suitable to be used in a conventional two-wire AC power and a grounding function is not able to be provided.

For improving the disadvantages mentioned above, the present invention provides a "Connecting device with cable".

SUMMARY OF THE INVENTION

One object of the present invention is to provide a connecting device with cable, the interior thereof has a grounding sheet so a grounding wire is able to be provided and a grounding function is achieved.

Another object of the present invention is to provide a connecting device with cable, an AC power plug thereof is changeable according to actual needs so is suitable to be used in different AC power systems.

For achieving the objects mentioned above, a connecting device with cable is provided by the present invention, includes: a top housing having a hollow main body, one end of the hollow main body is extended with a connecting device for being connected to a power adapter; an interior retaining sleeve, received in the hollow main body and has two ring slots; two copper contact rings, respectively installed in the two ring slots, one end of each of the copper contact rings is in a gradually expanding shape and is provided in the connecting device, the other end thereof has a clamping section; a bottom plastic housing, able to be engaged with the top housing, and having a bottom housing surface and a bottom housing sheet, the bottom housing surface has at least one housing wing member that is retained in the interior retaining sleeve, and the bottom housing sheet has a latching slot; a conduction wire retaining section, one end thereof has a positioning section for being mounted in the latching slot, and the positioning section has a retaining hole; and a cable having at least two conduction wires, one end thereof is received in the conduction wire retaining section and end sections of the two conduction wires enter into the top housing and the bottom plastic housing through the retaining hole and are respectively connected to the clamping section.

DETAILED DESCRIPTION OF THE PREFERRED EMBODIMENT

Figure 1A:
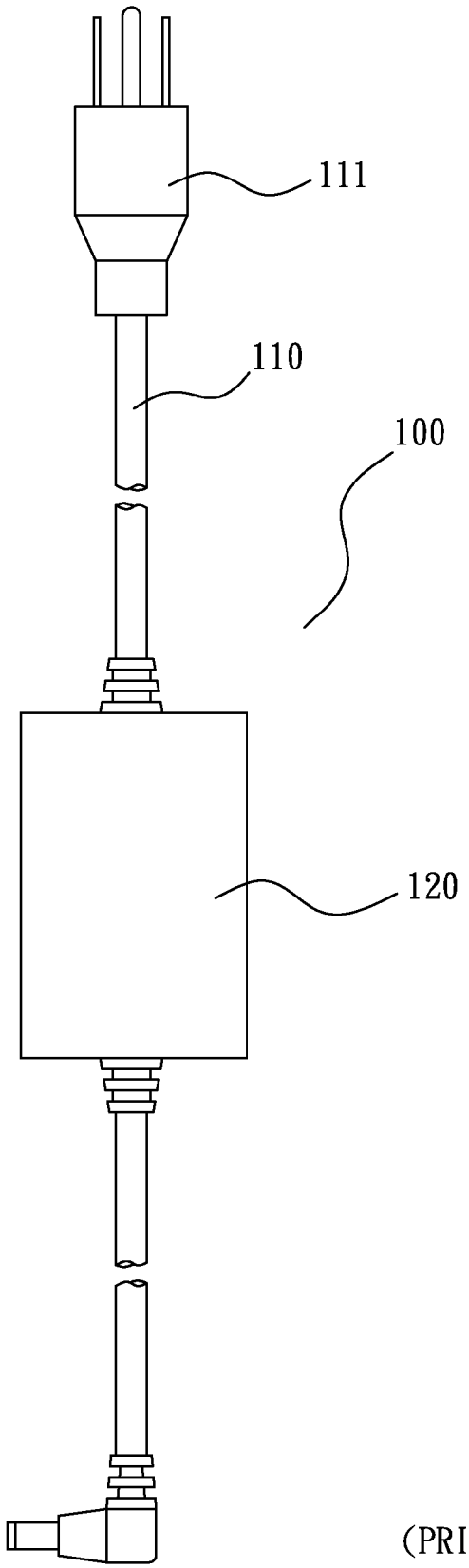
(PRIOR ART) FIG. 1a
FIG. 1*a* is a schematic view illustrating connection of a conventional power adapter.
Figure 1B:
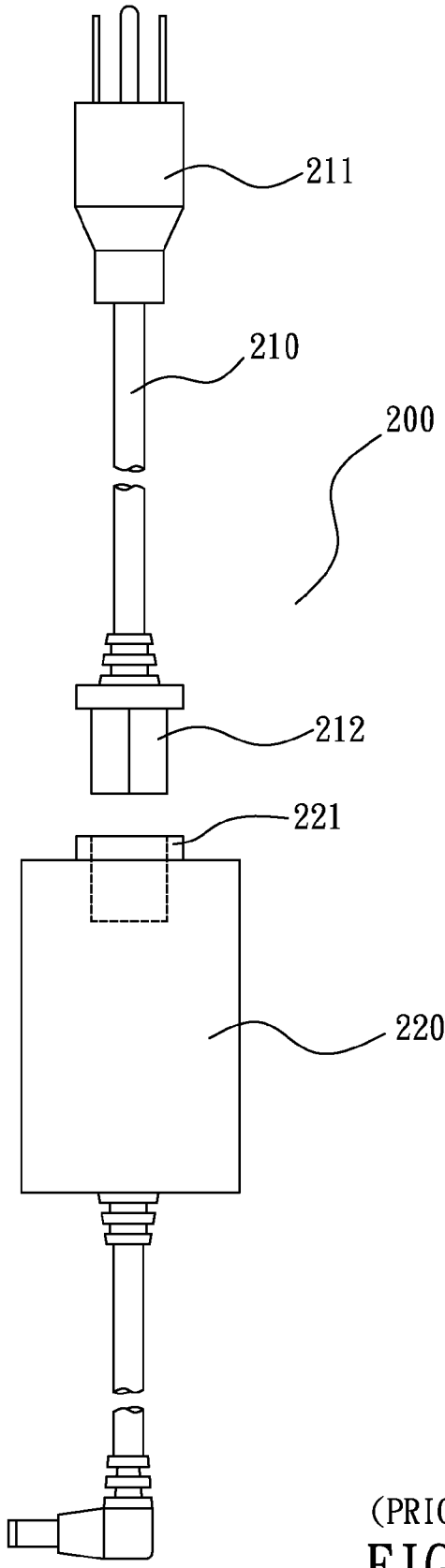
(PRIOR ART) FIG. 1b
FIG. 1*b* is a schematic view illustrating connection of another conventional power adapter.
Figure 2:
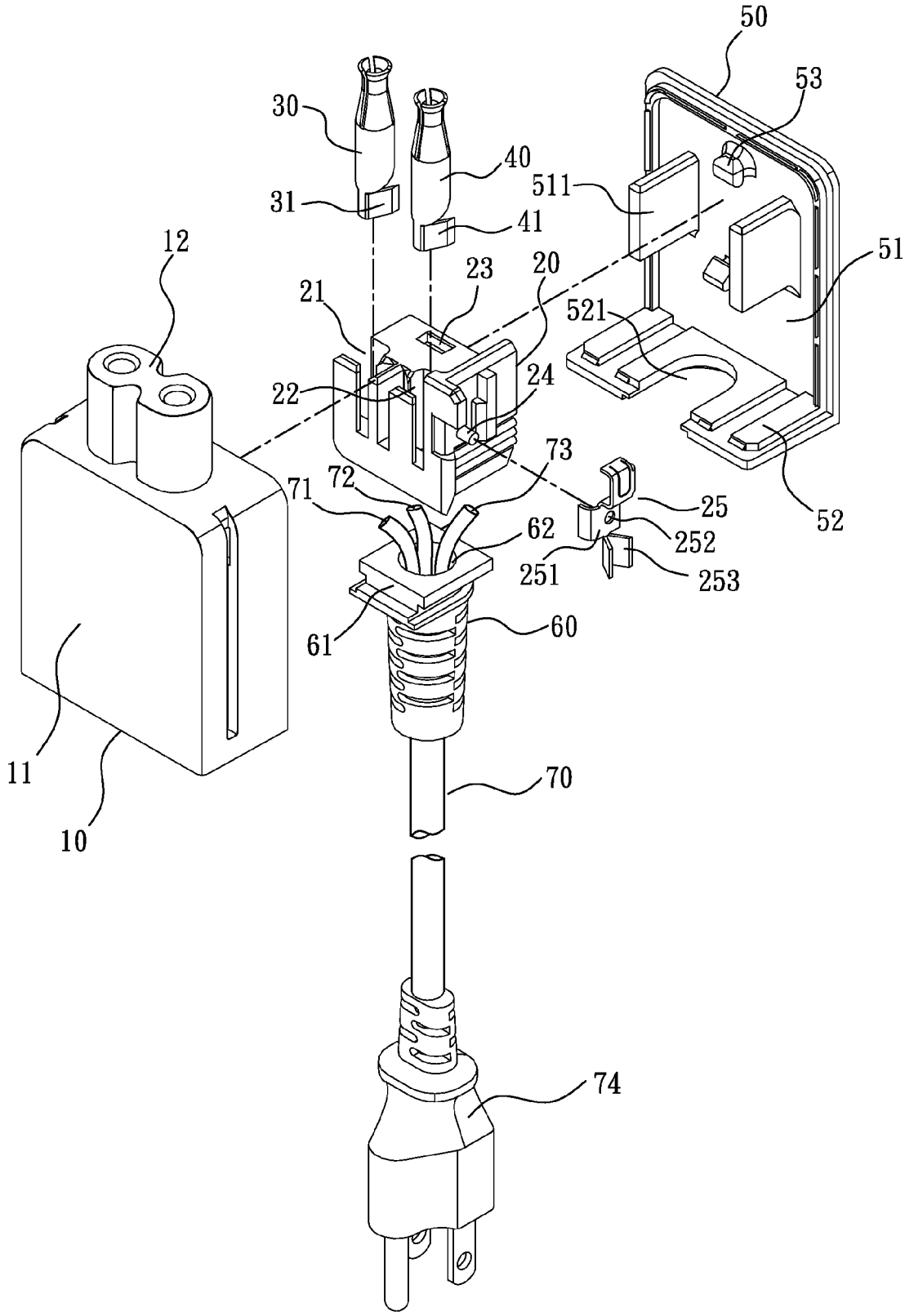
FIG. 2 is an exploded view of the connecting device with cable of one preferred embodiment of the present invention.
Figure 3:
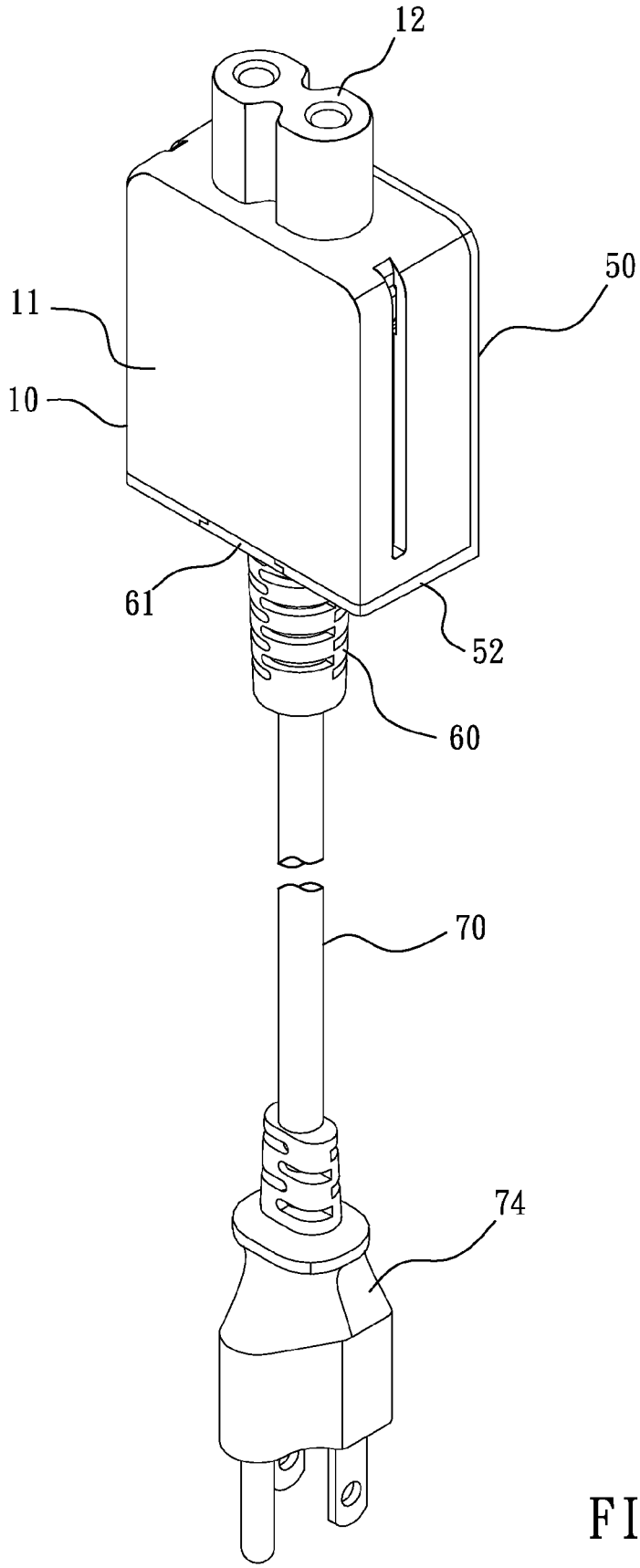
FIG. 3 is a schematic view of the assembly of the connecting device with cable of one preferred embodiment of the present invention.
Figure 4:
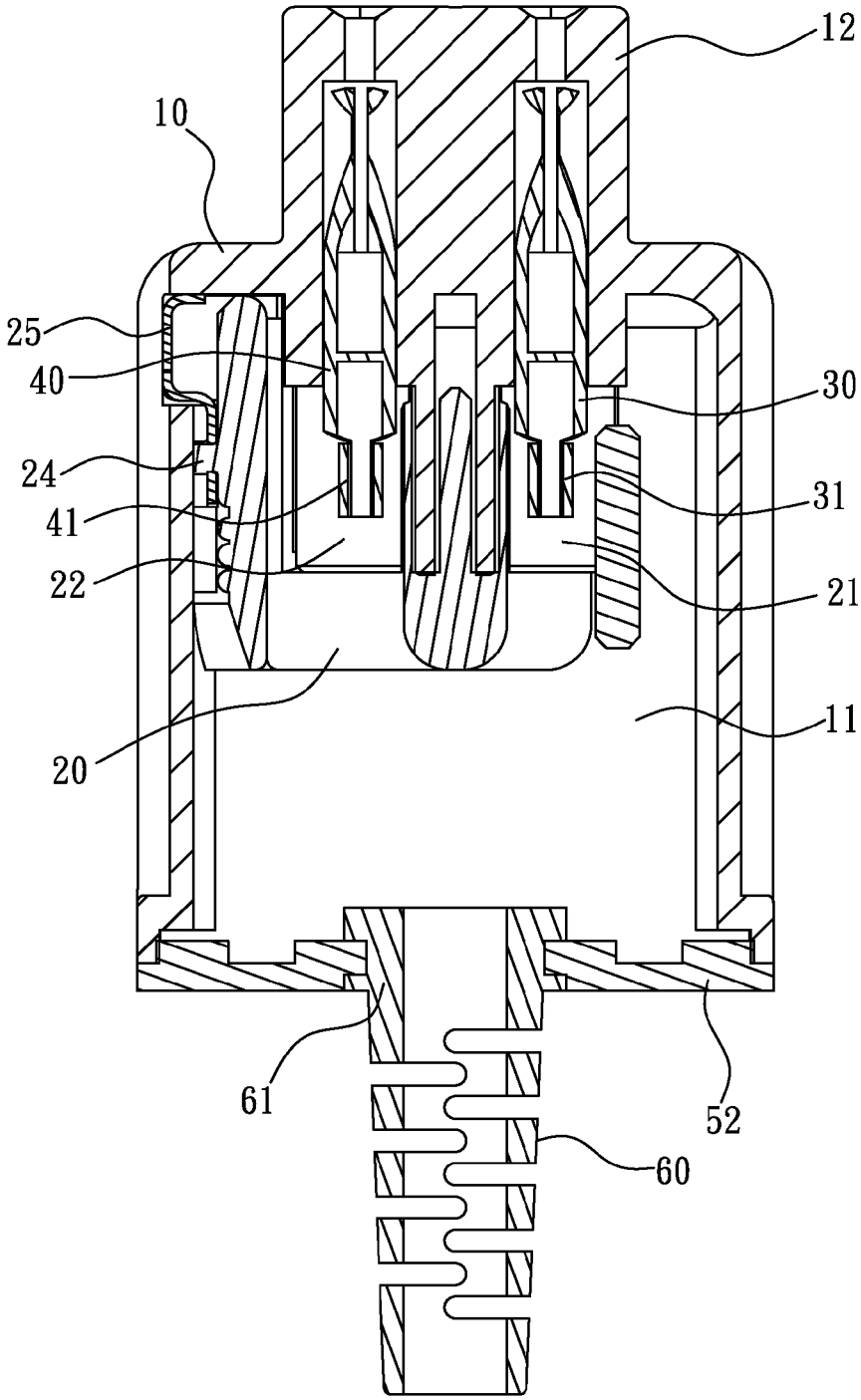
FIG. 4 is a cross sectional view of the assembly of the connecting device with cable of one preferred embodiment of the present invention.

Referring to FIG. 2 to FIG. 4, wherein FIG. 2 is an exploded view of the connecting device with cable of one preferred embodiment of the present invention; FIG. 3 is a schematic view of the assembly of the connecting device with cable of one preferred embodiment of the present invention; and FIG. 4 is a cross sectional view of the assembly of the connecting device with cable of one preferred embodiment of the present invention.

As shown in figures, the connecting device with cable provided by the present invention, suitable to be used in a portable electronic device e.g. a notebook computer, includes: a top hosing 10; an interior retaining sleeve 20; two copper contact rings 30, 40; a bottom plastic housing 50; a conduction wire retaining section 60; and a cable 70.

The top housing 10 has a hollow main body 11, and one end of the hollow main body 11 is extended with a connecting device 12 for being connected to a power adapter (not shown), the connecting device 12 is, e.g. but not limited to, a socket with a shape like the numeral 8.

The interior retaining sleeve 20 is received in the hollow main body 11 and has two ring slots 21, 22; and a front end of the interior retaining sleeve 20 is provided with a positioning slot 23, a right end thereof is provided with a sleeve tenon 24; the interior retaining sleeve 20 is further provided with a grounding sheet 25 having a main body 251, the main body 251 has a tenon hole 252 able to be received in the tenon slot 24, one end of the main body 251 is extended with a clamping section 253, the other end thereof is in a bended status.

The two copper contact rings 30, 40 are respectively provided in the two ring slot 21, 22, one end of each of the copper contact rings 30, 40 is in a gradually expanding shape and is provided in the connecting device 12, the other end thereof has a clamping section 31, 41.

The bottom plastic housing 50 is able to be engaged with the top housing 10, and has a bottom housing surface 51 and a bottom housing sheet 52, the bottom housing surface 51 is provided with at least one housing wing member 511 capable of being retained in the interior retaining sleeve 20, the bottom housing sheet 52 has a latching slot 521. The bottom plastic housing 50 is further provided with a positioning block 53, the positioning block 53 is received in the positioning slot 23 so the connection between the interior retaining sleeve 20 and the bottom plastic housing 50 is firmer. The material of which the top housing 10 and the bottom plastic housing 50 are, e.g. but not limited, plastic.

One end of the conduction wire retaining section 60 has a positioning section 61 which is able to be mounted in the latching slot 521, the positioning section 61 has a retaining hole 62.

The cable 70 has at least two conduction wires, 71, 72, e.g. but not limited to, L and N wires, one end thereof is received in the conduction wire retaining section 60; end sections of the two conduction wires 71, 72 enter the top housing 10 and the bottom plastic housing 50 through the retaining hole 62 then are respectively connected to the clamping section 31, 41. Moreover, the cable 70 is further provided with a grounding wire 73 which enters the top housing 10 and the bottom plastic housing 50 through the retaining hole 62 and is clamped on the clamping section 253 of the grounding sheet 25. The other end of the cable 70 is provided with a plug 74 for being connected to a socket (not shown) for obtaining required AC power, the plug 74 is a, e.g. but not limited to, MEMA5-15P, AS/NZS3112, SANS164-1/SABS, IEC60320-1, K60884, KSC8035, IEC60884, GB2009.1 or GB1002 plug.

As shown in FIG. 3 and FIG. 4, when being assembled, the interior retaining sleeve 20 is firstly provided on the housing wing member 511 of the bottom plastic housing 50 and is positioned and retained through latching of the positioning slot 23 and the positioning block 53; the cable 70 is provided in the conduction wire retaining section 60 and the conduction wire retaining section 60 is provided in the latching slot 521, so the conduction wires, 71, 72, 73 are exposed outside the retaining hole 62; then the two copper contact rings 30, 40 are provided on the connecting device 12 installed on the top housing 10, and part of the two copper contact rings 30, 40 are exposed; the grounding sheet 25 is retained on the interior retaining sleeve 20 through the sleeve tenon 24; then the conduction wires 71, 72, 73 are respectively coupled with the clamping sections, 31, 41, 253 and are welded or clamped thereon; lastly the top housing 10 is engaged with the bottom plastic housing 50, the connecting device with cable provided by the present invention is therefore obtained. The conduction wires 71, 72, 73, after the connecting device with cable provided by the present invention is assembled, are respectively coupled with the clamping sections 31, 41, 253, and the clamping section 253 is fastened on a lateral side of the top housing 10, so when the connecting device 12 is connected to the power adapter, AC power can be transferred to the power adapter through the copper contact rings 30, 40; and the grounding sheet 25 is able to be connected to a grounding circuit in the power adapter through a corresponding mechanism provided in the power adapter, therefore a grounding circuit is obtained. So a three-wire connection (L, N and GND) is able to be connected by the connecting device with cable provided by the present invention.

Figure 5A:
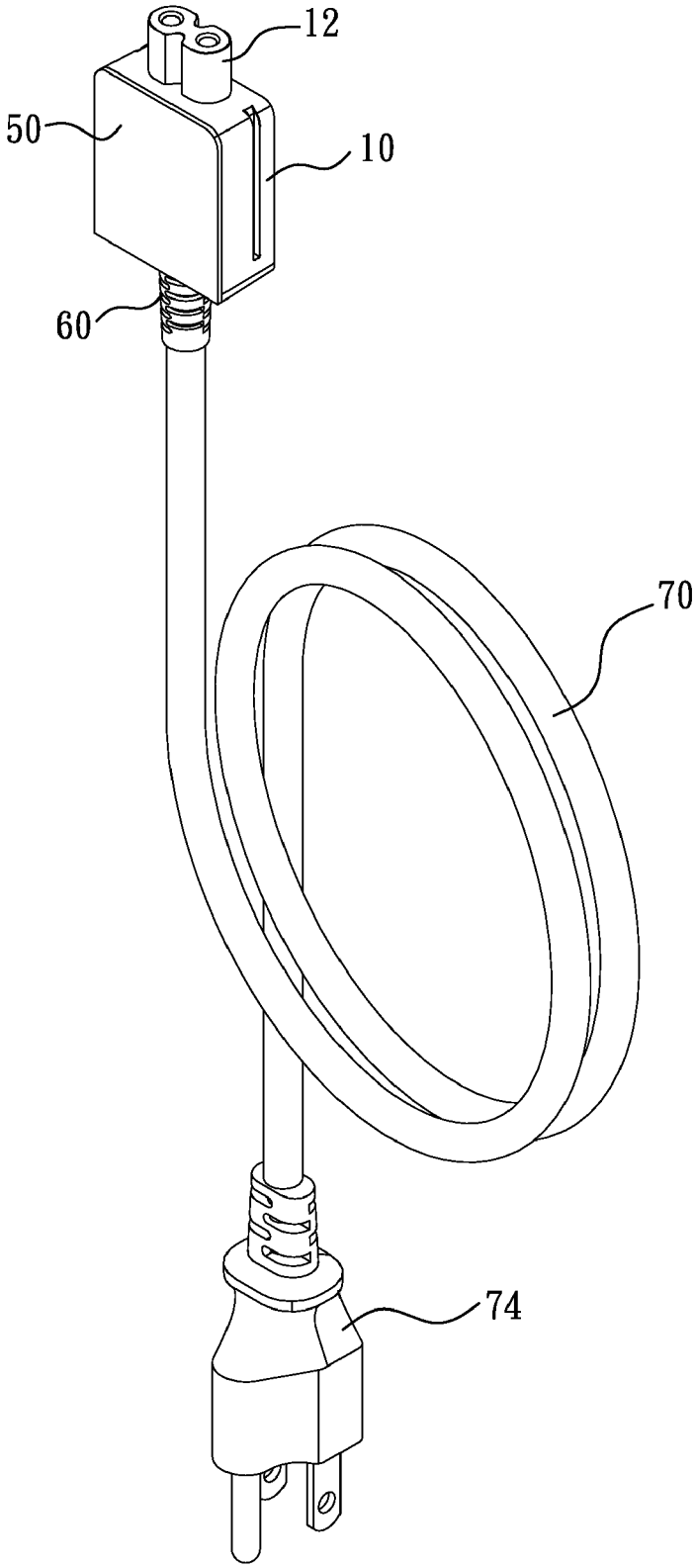
FIG. 5*a* is a schematic view of a plug of one preferred embodiment of the present invention.
Figure 5B:
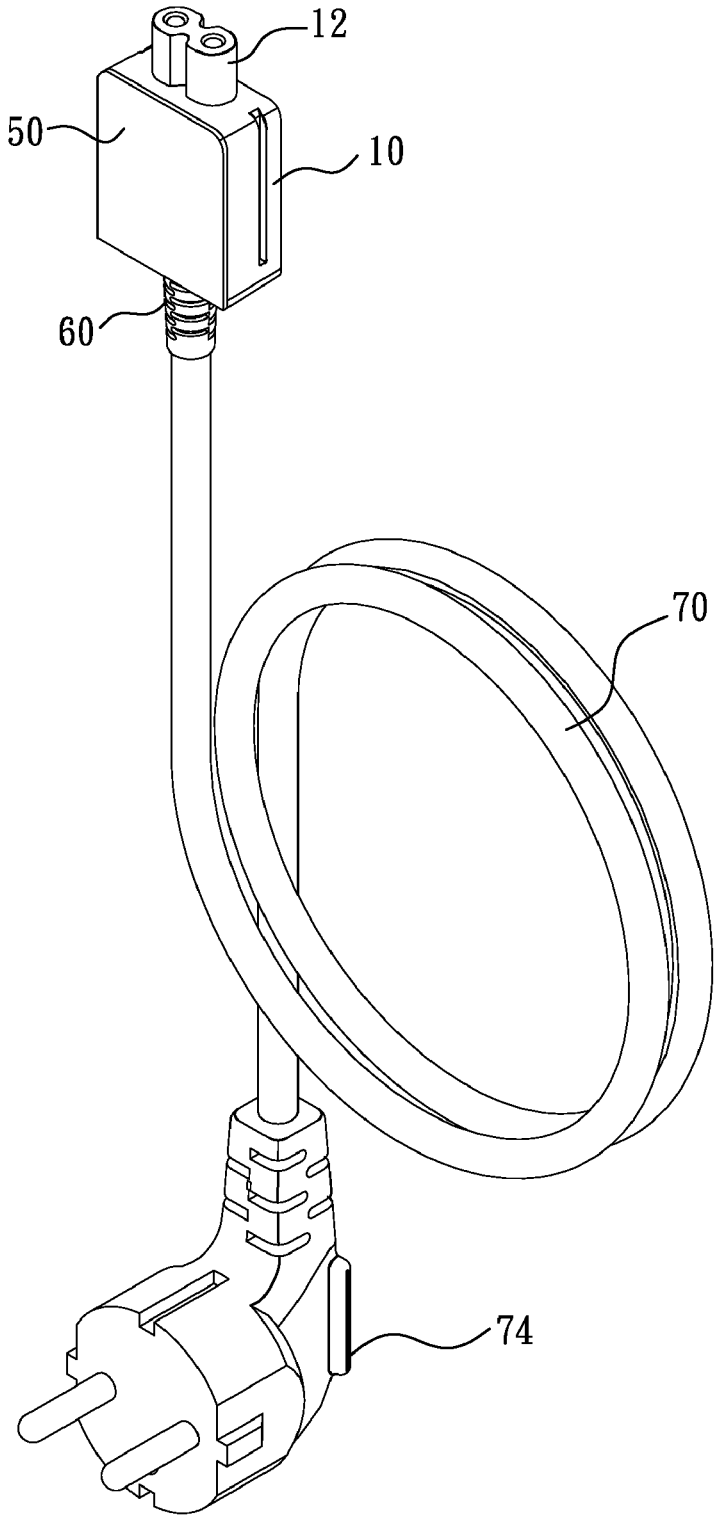
FIG. 5*b* is a schematic view of another plug of another preferred embodiment of the present invention.
Figure 5C:
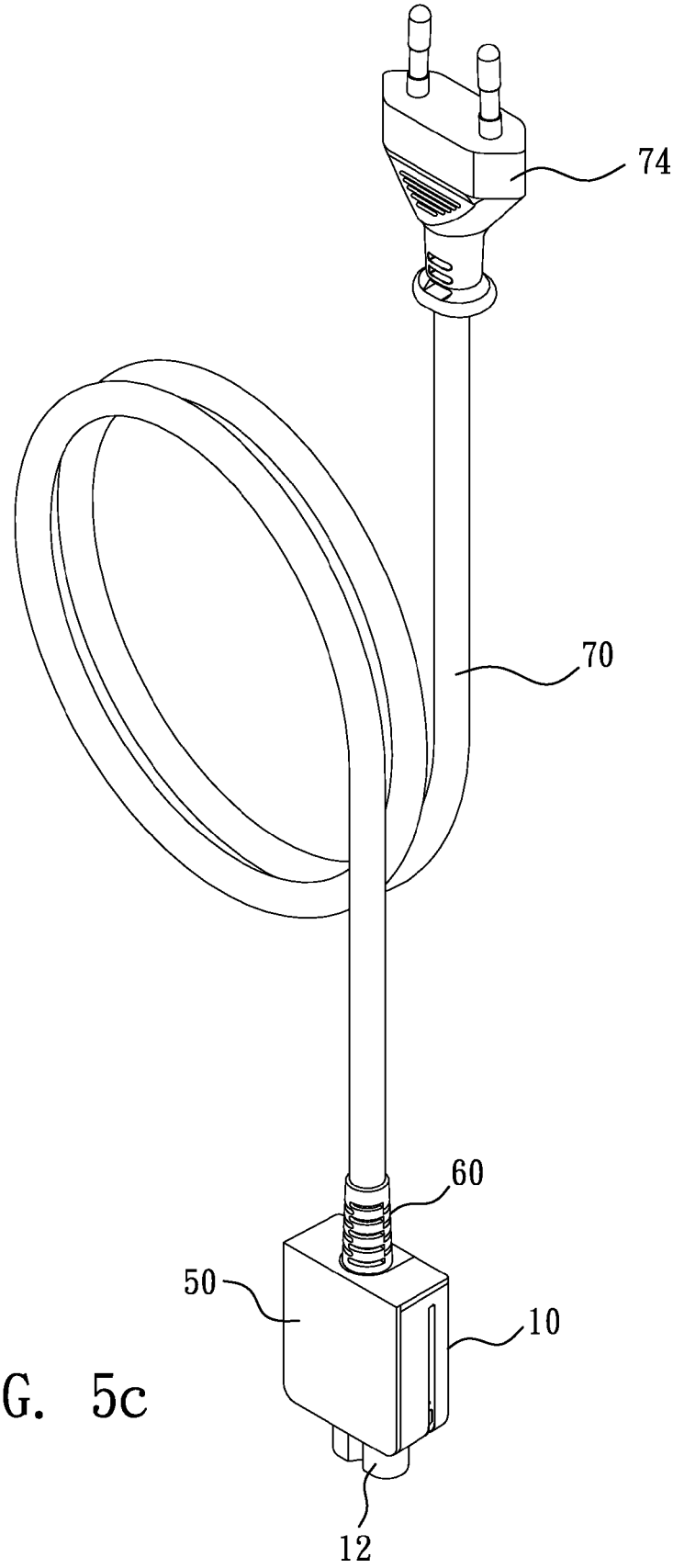
FIG. 5*c* is a schematic view of another plug of one another preferred embodiment of the present invention.
Figure 5D:
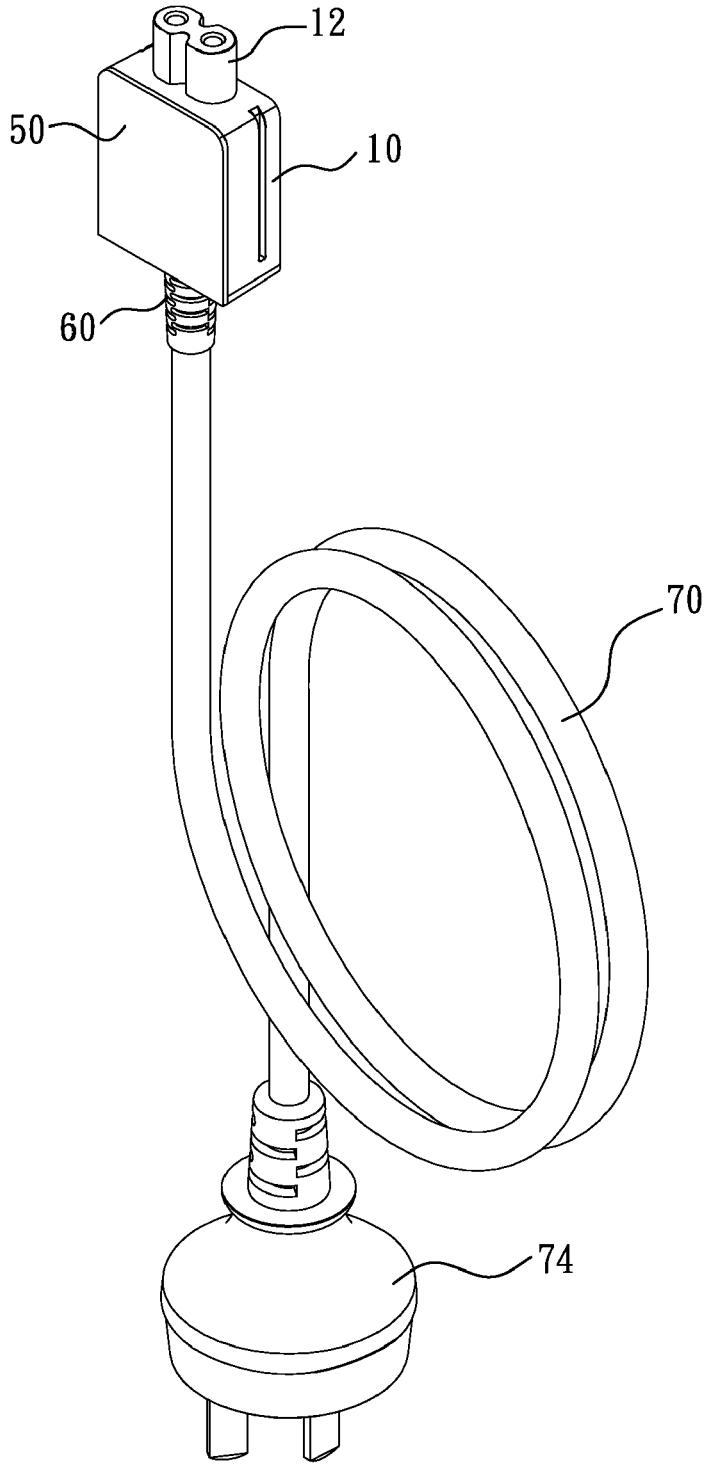
FIG. 5*d* is a schematic view of another plug of one another preferred embodiment of the present invention.
Figure 5E:
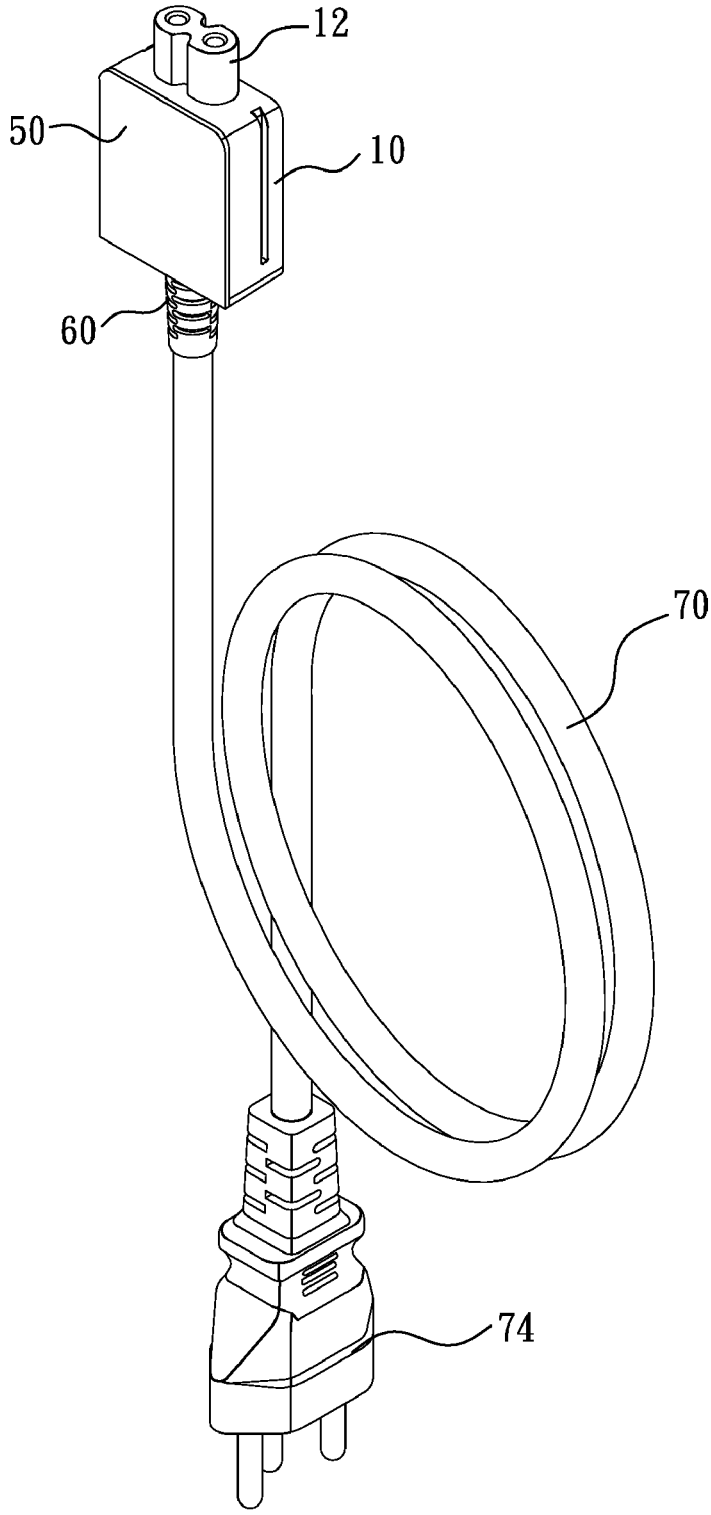
FIG. 5*e* is a schematic view of another plug of one another preferred embodiment of the present invention.
Figure 5F:
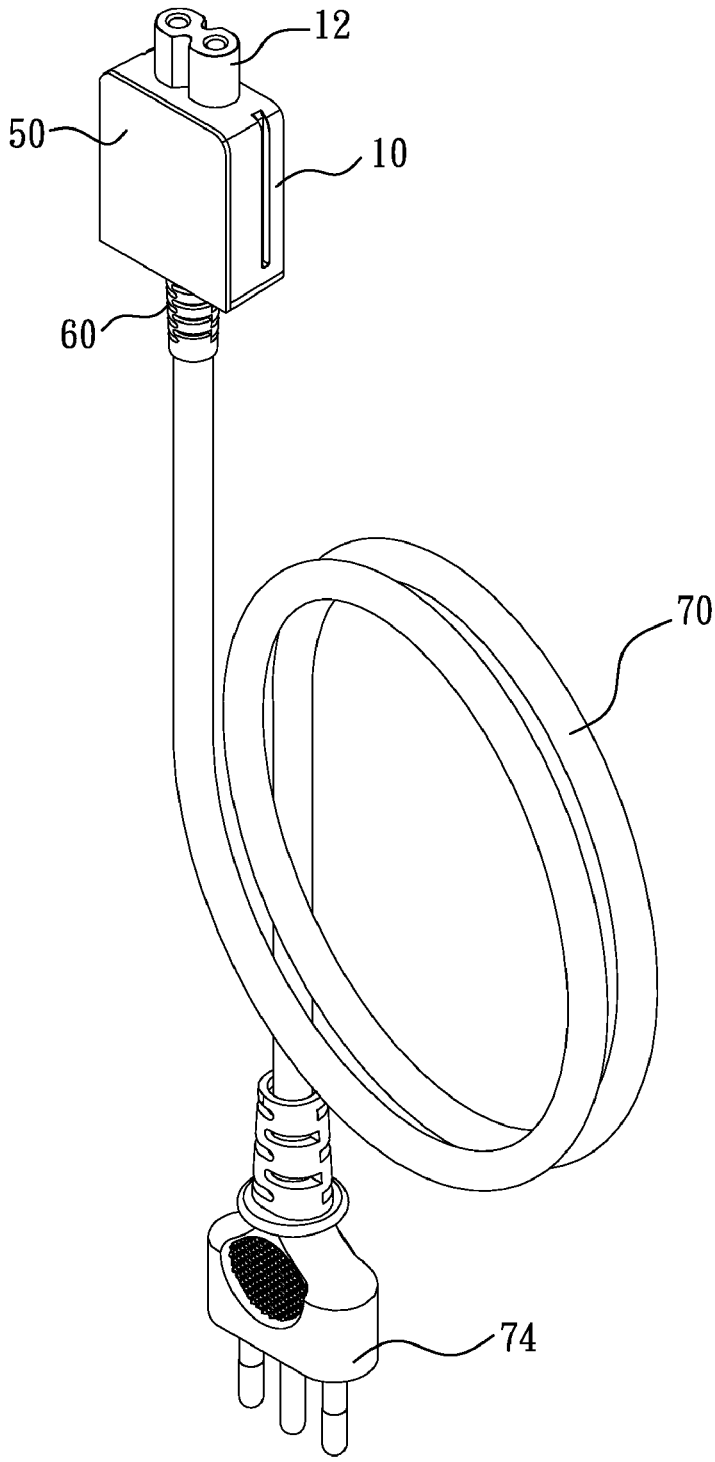
FIG. 5*f* is a schematic view of another plug of one another preferred embodiment of the present invention.
Figure 5G:
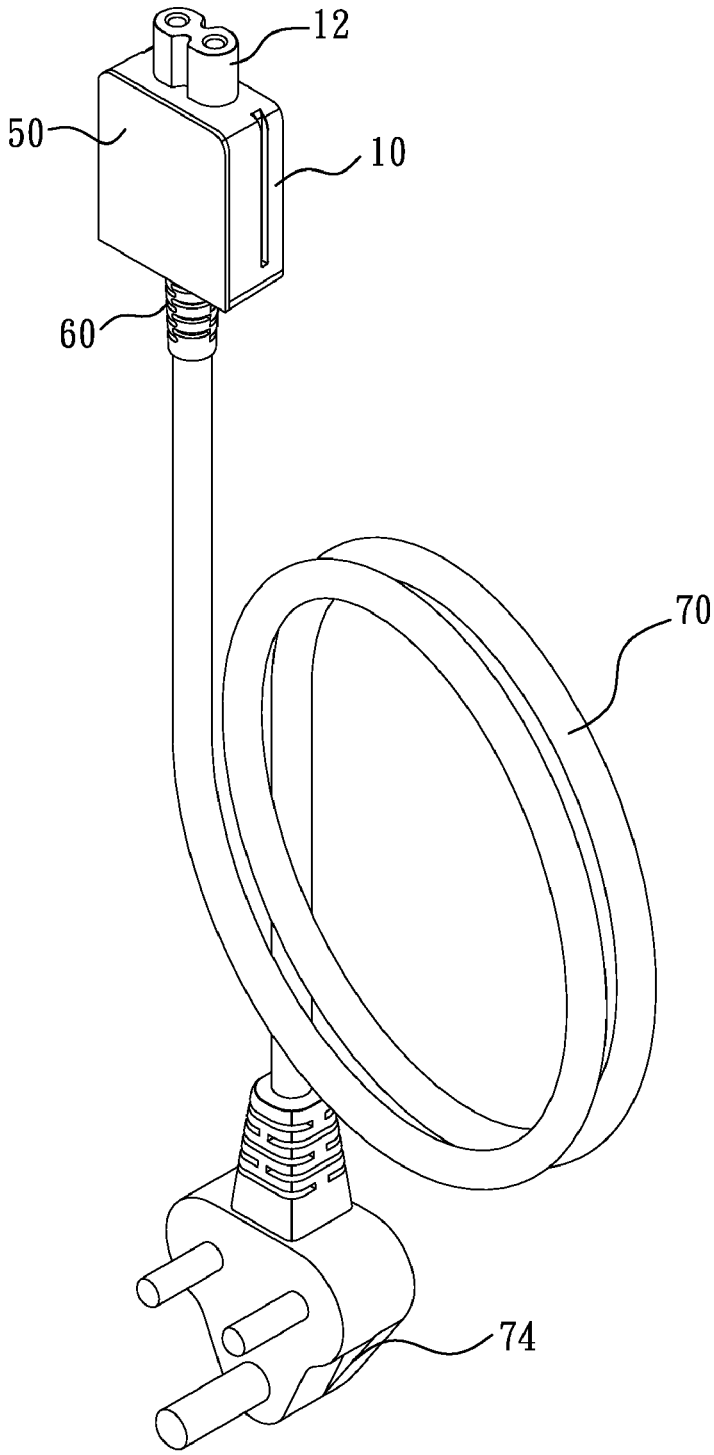
FIG. 5*g* is a schematic view of another plug of one another preferred embodiment of the present invention.
Figure 5H:
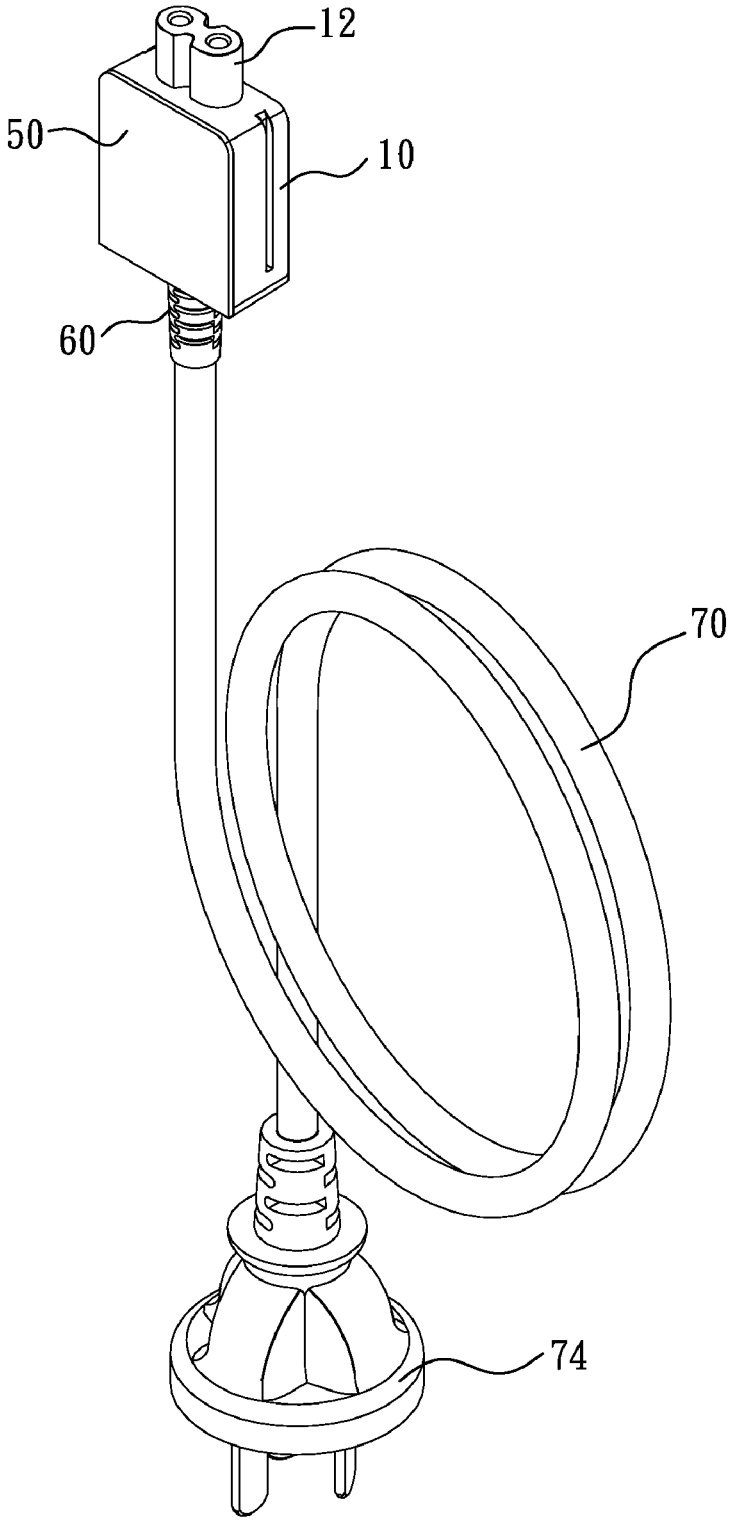
FIG. 5*h* is a schematic view of another plug of one another preferred embodiment of the present invention.

Referring to FIG. 5*a* to FIG. 5*h*, wherein FIG. 5*a* is a schematic view of a plug of one preferred embodiment of the present invention; FIG. 5*b* is a schematic view of another plug of another preferred embodiment of the present invention; FIG. 5*c* is a schematic view of another plug of one another preferred embodiment of the present invention; FIG. 5*d* is a schematic view of another plug of one another preferred embodiment of the present invention; FIG. 5*e* is a schematic view of another plug of one another preferred embodiment of the present invention; FIG. 5*f* is a schematic view of another plug of one another preferred embodiment of the present invention; FIG. 5*g* is a schematic view of another plug of one another preferred embodiment of the present invention. FIG. 5*h* is a schematic view of another plug of one another preferred embodiment of the present invention.

As shown in FIG. 5*a*, the plug 74 of the present invention is a MEMA5-15P plug suitable to be used in areas such as America or Canada, etc.

As shown in FIG. 5*b*, the plug 74 of the present invention is an AS/NZS3112 plug having two conduction wires and suitable to be used in areas such as Australia or New Zealand, etc.

As shown in FIG. 5*c*, the plug 74 of the present invention is a K60884 plug suitable to be used in areas such as European Union.

As shown in FIG. 5*d*, the plug 74 of the present invention is an AS/NZS3112 plug having three conduction wires and suitable to be used in areas such as Australia or New Zealand, etc.

As shown in FIG. 5*e*, the plug 74 of the present invention is an IEC60884 plug having three conduction wires and suitable to be used in Switzerland.

As shown in FIG. 5*f*, the plug 74 of the present invention is a CE123-50 plug having three conduction wires and suitable to be used in Italy.

As shown in FIG. 5*g*, the plug 74 of the present invention is an IEC60884 plug having three conduction wires and suitable to be used in areas such as African or India, etc.

As shown in FIG. 5*h*, the plug 74 of the present invention is an SANS164-1/SABS 164-1 plug having three conduction wires and suitable to be used in China.

As mentioned above, the connecting device with cable provided by the present invention has a grounding sheet provided inside so a grounding wire is able to be connected and provides a grounding function; and the AC power plug is changeable according to actual needs so is suitable to be sued in different AC power systems.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connecting device with cable, comprising:

a top housing having a hollow main body with one end of the hollow main body extended with a connecting device for being connected to a power adapter;

an interior retaining sleeve, received in the hollow main body and having two ring slots;

two copper contact rings, respectively installed in the two ring slots, wherein one end of each of the copper contact rings is in a gradually expanding shape and is provided in the connecting device, the other end thereof has a clamping section;

a bottom plastic housing, able to be engaged with the top housing, and having a bottom housing surface and a bottom housing sheet, wherein the bottom housing surface has at least one housing wing member that is retained in the interior retaining sleeve, and the bottom housing sheet has a latching slot;

a conduction wire retaining section, one end thereof having a positioning section for being mounted in the latching slot, and the positioning section having a retaining hole; and a cable having at least two conduction wires, wherein one end thereof is received in the conduction wire retaining section and end sections of the two conduction wires enter into the top housing and the bottom plastic housing through the retaining hole are respectively connected to the clamping section.

2. The connecting device with cable as claimed in claim 1, wherein the material of which the top housing and the bottom plastic housing are made are an insulation material.

3. The connecting device with cable as claimed in claim 1, wherein a front end of the interior retaining sleeve is provided with a positioning slot, a right end thereof is provided with a sleeve tenon.

4. The connecting device with cable as claimed in claim 3, wherein the bottom plastic housing is further provided with a positioning block received in the positioning slot so the connection between the interior retaining sleeve and the bottom plastic housing is stable and firm.

5. The connecting device with cable as claimed in claim 3, wherein a grounding sheet is further provided and the grounding sheet has a main body, the main body has a tenon hole able to be received in the tenon slot, one end of the main body is extended with a clamping section, the other end thereof is in a bended status.

6. The connecting device with cable as claimed in claim 5, wherein the cable is further provided with a grounding wire, the grounding wire enters the top housing and the bottom plastic housing through the retaining hole then is connected to the clamping section of the grounding sheet.

7. The connecting device with cable as claimed in claim 1, wherein the connecting device is a socket with a shape like numeral 8.

8. The connecting device with cable as claimed in claim 1, wherein the other end of the cable is provided with a plug.

9. The connecting device with cable as claimed in claim 8, wherein the plug is a MEMA5-15P, AS/NZS3112, SANS164-1/SABS, IEC60320-1, K60884, KSC8035, IEC60884, GB2009.1 or GB1002 plug.

* * * * *